US006890212B2

(12) United States Patent
Mase et al.

(10) Patent No.: US 6,890,212 B2
(45) Date of Patent: May 10, 2005

(54) CONNECTOR

(75) Inventors: Tsuyoshi Mase, Yokkaichi (JP); Tsutomu Tanaka, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 10/824,146

(22) Filed: Apr. 14, 2004

(65) Prior Publication Data

US 2004/0209517 A1 Oct. 21, 2004

(30) Foreign Application Priority Data

Apr. 18, 2003 (JP) ..... 2003-114718

(51) Int. Cl.[7] ..... H01R 13/40
(52) U.S. Cl. ..... 439/595; 439/752; 439/352
(58) Field of Search ..... 439/595–598, 439/752–752.5, 352

(56) References Cited

U.S. PATENT DOCUMENTS 4,867,711 A * 9/1989 Yuasa ..... 439/752
5,316,504 A * 5/1994 Jinno ..... 439/752
5,554,052 A * 9/1996 Saijo et al. ..... 439/595
6,341,985 B2 1/2002 Kodama
6,464,544 B1 10/2002 Yamamoto et al.

* cited by examiner

*Primary Examiner*—Truc Nguyen
(74) *Attorney, Agent, or Firm*—Gerald E. Hespos; Anthony J. Casella

(57) ABSTRACT

Reinforcements (19) bulge out toward the center of a tab insertion opening (14) from corners of an opening edge of the tab insertion opening (14) extending along a partition wall (18) of a connector housing (10). The partition wall (18) is made thicker and stronger by the reinforcements (19). Thus, the partition wall (18) is prevented from damage and/or deformation even if a tab (21*a*) or the like strikes against the partition wall. The partition wall (18) is made thicker only at the ends of the side edge of the tab insertion opening (14) extending along the partition wall (18). Thus, an opening area of the tab insertion opening (14) still is substantially rectangular and the insertion of the tab (21*a*) is not hindered.

8 Claims, 8 Drawing Sheets

CONNECTOR

BACKGROUND OF THE INVENTION

1. Field of the Invention

The invention relates to a female connector with a tab insertion opening for permitting the insertion of the tab of a male terminal fitting.

2. Description of the Related Art

U.S. Pat. No. 6,464,544 and FIG. 10 herein disclose a female connector. With reference to FIG. 10, the female connector has a synthetic resin housing 100 and cavities are formed in the housing. Female terminal fittings are inserted into the cavities and are locked by locks in the cavities. Tab insertion openings 101 are formed in the front surface of the housing 100 and communicate with the cavities. Tabs of the male terminal fittings can be inserted through the tab insertion openings 101 for connection with the female terminal fittings in the cavities.

The terminal fittings may have to be removed for maintenance. Thus, jig insertion openings 102 are formed near the tab insertion openings 101 in the front surface of the housing 100. A long narrow jig can be inserted into the jig insertion opening 102 to disengage the lock from the terminal fitting so that the terminal fitting can be withdrawn from the cavity.

Many connectors are miniaturized. Thus, intervals between the tab insertion openings 101 and the jig insertion openings 102 are narrowed, thereby thinning partition walls 103 between the openings 101, 102. Thinner partition walls 103 have a lower strength, and there is a possibility that the partition wall 103 will be damaged when the tab or the jig strikes against the partition wall 103.

The problem of damaging a partition wall is not restricted to cases where the partition wall separates a tab insertion opening and a jig insertion opening. Rather other partition walls can be damaged as a connector is miniaturized.

The present invention was developed in view of the above problem and an object thereof is to enhance the strength of a partition wall partitioning a tab insertion opening and an opening adjacent thereto.

SUMMARY OF THE INVENTION

The invention relates to a connector with a housing that preferably is made of a synthetic resin. The housing is formed with at least one cavity, and at least one female terminal fitting is insertable into the cavity. At least one substantially rectangular tab insertion opening is formed in the front surface of the housing and communicates with the cavity. The tab insertion opening permits a tab at the leading end of a male terminal fitting to be inserted into the cavity. At least one opening is formed in the front surface of the housing and is at least partly partitioned from the tab insertion opening by a partition wall. An arcuate or slanted reinforcement bulges towards the center of the tab insertion opening from at least one side edge of the tab insertion opening. The reinforcement extends along the partition wall. Reinforcements preferably are formed at all four corners of the opening edge of the tab insertion opening.

The partition wall is thicker and stronger at the reinforcement. Accordingly, the partition wall is prevented from damage and/or deformation even if the tab or the like strikes against the partition wall. The partition wall is made thicker only at the ends of the side edge of the tab insertion opening extending along the partition wall. Thus, the tab insertion opening still is substantially rectangular and the insertion of the tab is not hindered.

Stresses could concentrate if boundaries between the side edges of the tab insertion opening and the inner peripheral surface of the reinforcing portion were angular corners. However, side edges of the tab insertion opening and inner peripheral surfaces of the reinforcement preferably are smoothly continuous with each other. Thus, stress concentrations can be avoided.

A tapered guide may be formed at at least part of the opening edge of the tab insertion opening in the front surface of the housing and defines an opening area that increases from a cavity side towards the front surface of the housing. The reinforcement has an inner peripheral surface substantially in the form of a section of a conical surface and a radius of curvature of an arc of the inner circumferential surface may increase from the front surface of the housing toward the cavity side in the guide. The opening area of the guide may be at its maximum and the radius of curvature of the arc of the reinforcement at the corner of the guide may be at its minimum at the front surface of the housing. Thus, a larger opening area of the guide is ensured to achieve a more reliable guiding of a displaced tab to the cavity as compared to a case where the radius of curvature of the arc of the reinforcement is constant.

In an alternate embodiment, the radius of curvature of an arc of the inner circumferential surface of the reinforcement may decrease from the side of the front surface of the housing toward the cavity side in the tapered guide. The radius of curvature of the arc of the reinforcement at the corner of the guide is at its minimum at a portion of the tab insertion opening where the tab closely penetrates. Thus, the inner surfaces of the tab insertion opening are closer to the tab and shaking of the tab in the tab insertion opening is reduced.

The reinforcement may be formed to have a substantially slanted inner peripheral surface and the width of the slanted inner peripheral surface may increase from the side of the front surface of the housing toward the cavity side. The opening area of the guide may be at its maximum and the width of the slanted inner peripheral surface of the reinforcement at the corner of the guide may be at its minimum at the front surface of the housing. Thus, a larger opening area of the guide can be ensured to improve the reliability of a function of guiding the displaced tab to the cavity as compared to a case where the slanted inner surface is constant.

As an alternate, the reinforcement may have a substantially slanted inner peripheral surface with a width that decreases from the side of the front surface of the housing toward the cavity side. The width of the slanted inner peripheral surface of the reinforcement at the corner of the guide is at its minimum at the portion of the tab insertion opening where the tab penetrates. Thus, inner surfaces of the tab insertion opening are located closer to the tab to reduce shaking of the tab.

The opening is a jig insertion opening for inserting a jig into the housing.

The tab insertion opening preferably comprises a positioning portion for positioning the tab with respect to transverse and/or vertical directions.

The opening preferably has a portion with a maximum width that is larger than the maximum width of the positioning portion, but smaller than the maximum width of the guide.

These and other features of the invention will become more apparent upon reading the following description of preferred embodiments and accompanying drawings. Even though embodiments are described separately, single features may be combined with other embodiments.

DETAILED DESCRIPTION OF THE PREFERRED EMBODIMENTS

Figure 1:
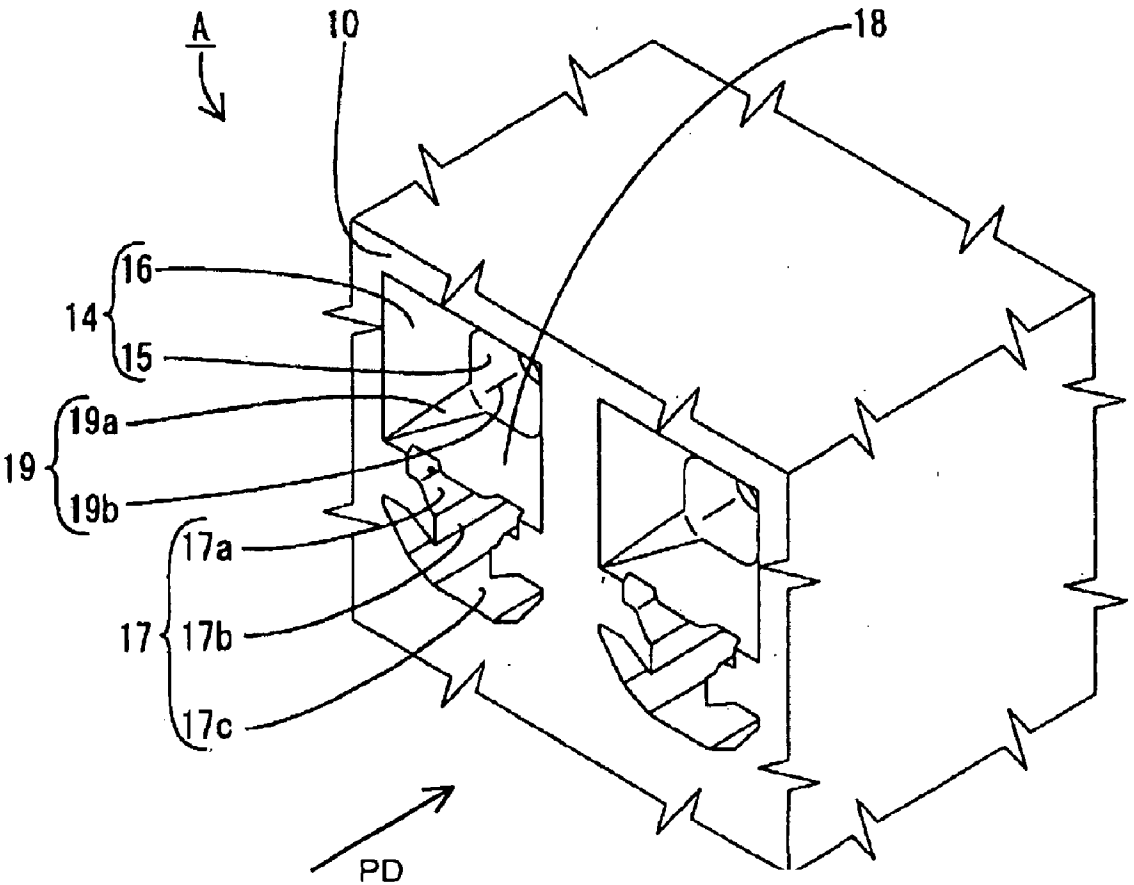
FIG. 1 is a partial perspective view of a connector according to a first embodiment.
Figure 2:
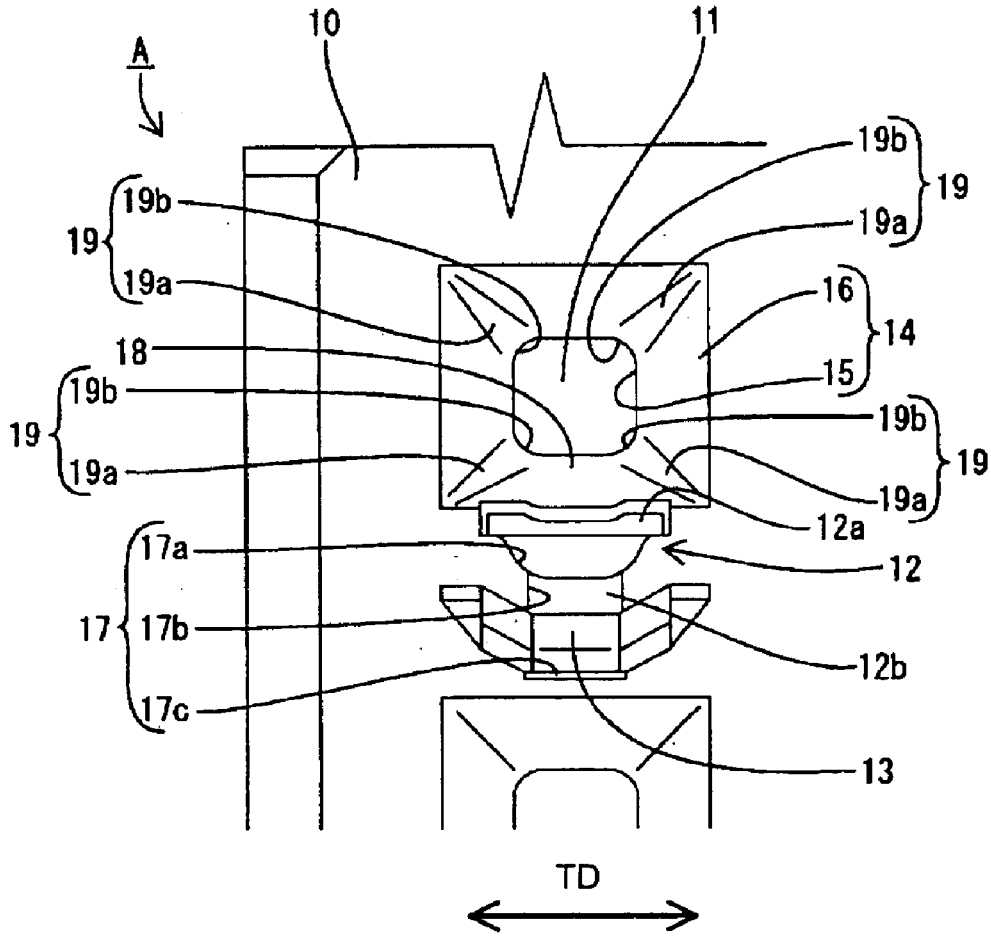
FIG. 2 is a partial enlarged front view of the connector according to the first embodiment.
Figure 3:
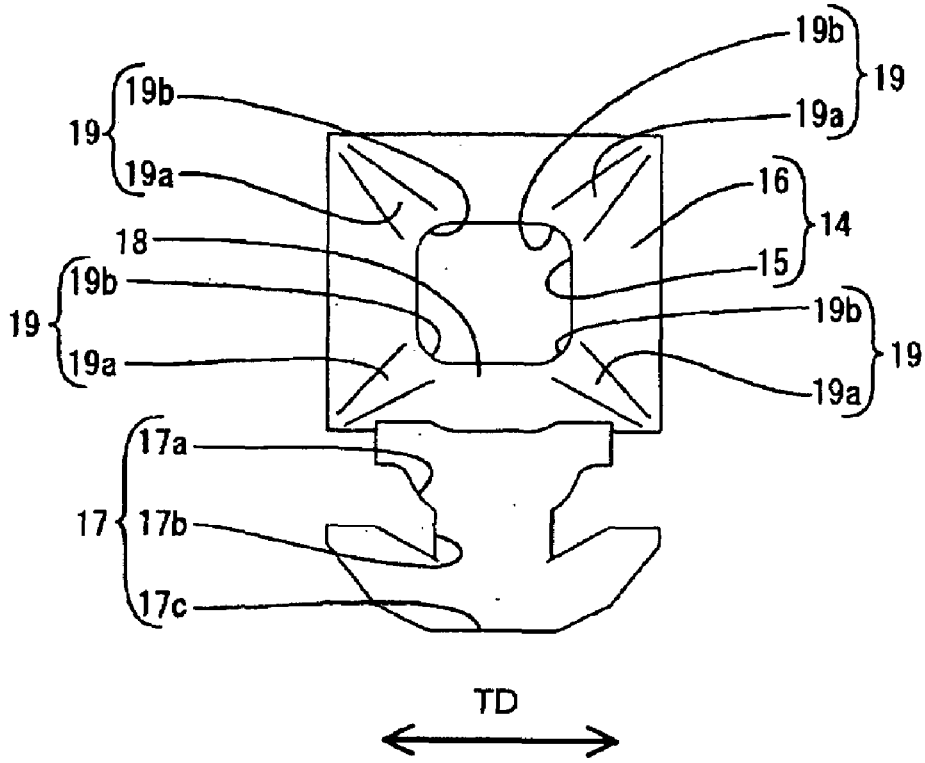
FIG. 3 is a partial enlarged front view showing the shapes of openings formed in the front end surface of the housing of the first embodiment.
Figure 4:
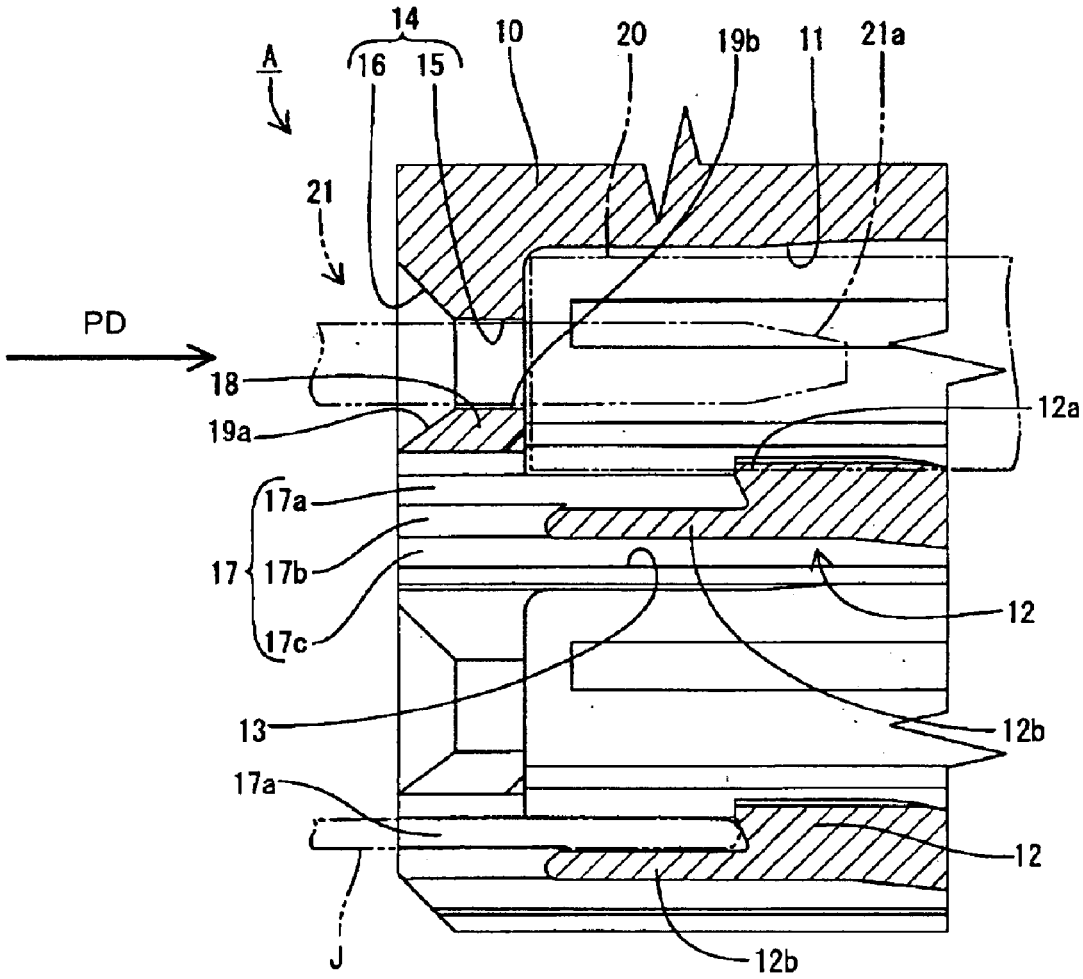
FIG. 4 is a partial section of the connector according to the first embodiment.

The letter A in FIGS. 1 to 4 identifies a connector according to a first embodiment of the invention. The connector A has a housing 10 made e.g. of a synthetic resin. Long narrow cavities 11 of substantially rectangular lateral cross extend through the housing 10 in forward and backward directions, and a lock 12 is cantilevered forward along the bottom surface of each cavity 11. The connector A also includes female terminal fittings 20 that are inserted into the cavities 11 from the rear end of the housing 10. The lock 12 engages a locking hole of the female terminal fitting 20 that has been inserted to a proper position in the respective cavity 11 to hold the female terminal fitting 20 so as not to come out. The lock 12 can be deflected into a deformation space 13 below the lock 12 to cancel the locked state of the female terminal fitting 20.

A tab insertion opening 14 opens into each cavity 11 at the front surface of the housing 10 (left end in FIG. 4) and penetrates the front wall of the cavity 11 substantially along forward and backward directions. A long narrow tab 21*a* at the leading end of a male terminal fitting 21 is insertable through the tab insertion opening 14 from the front. The lateral cross section of the tab 21*a* is substantially square. The female and male terminal fittings 20 and 21 are connected electrically by inserting the tab 21*a* through the tab insertion opening 14 and into the female terminal fitting 20 in the cavity 11.

Each tab insertion opening 14 has a substantially square cross section when the housing 10 is viewed from front. A positioning portion 15 is defined at a rear portion of the tab insertion opening 14 with respect to a penetrating direction PD of the tab 21*a* (i.e. a portion adjacent the cavity 11) and has a lateral cross-sectional area that is substantially constant along the penetrating direction PD of the tab 21*a*. The lateral cross section of the positioning portion 15 substantially corresponds to the lateral cross-section of the tab 21*a*. Thus, the positioning portion 15 prevents the tab 21*a* from shaking vertically and/or transversely in directions normal to the penetrating direction PD of the tab 21*a* and prevents the tab 21*a* from taking an oblique posture.

A tapered guide 16 is defined at the front portion of the tab insertion opening 14 and is substantially continuous with the front end of the positioning portion 15. The tapered guide 16 is enlarged gradually from a cavity side towards the front surface of the housing 10. The leading end of a tab 21*a* that approaches the tab insertion opening 14 in a vertically and/or transversely displaced position will contact the slanted surface of the guide 16 and the alignment of the displaced tab 21*a* is corrected by the slanted surfaces.

Jig insertion openings 17 are formed in the front surface of the housing 10 by removing a mold that forms front parts of the locks 12 and the deformation spaces 13 below the locks 12. Thus, the corresponding jig insertion openings 17 and deformation spaces 13 communicate with each other. The jig insertion openings 17 are right below the corresponding tab insertion openings 14. Each jig insertion opening 17 is substantially transversely symmetrical, and an axis of symmetry coincides with a longitudinal axis of the tab insertion opening 14 with respect to the transverse direction TD, and includes an upper opening 17*a*, a middle opening 17*b* and a bottom opening 17*c* disposed in this order. The upper opening 17*a* is closer to the tab-insertion opening 14 while the bottom opening 17*c* is most distanced from the tab-insertion opening 14.

The upper opening 17*a* is substantially in the form of an inverted trapezoid, and notches are formed at the upper ends of the left and right oblique sides thereof substantially in the transverse direction TD. The upper opening 17*a* has a maximum width at a height where the notches are formed, and this width is larger than the width of the positioning portion 15, but smaller than the maximum width of the guide 16. The upper opening 17*a* is at substantially the same height as a locking projection 12*a* of the lock 12.

The middle opening 17*b* is substantially in the form of a wide rectangle, and has a width substantially equal to a dimension of the bottom side of the upper opening 17*a*. The middle opening 17*b* is at substantially the same height as a jig placing portion 12*b* of the lock 12 that projects more forward than the locking projection 12*a*. The bottom opening 17*c* is wide, and left and right sides extend obliquely up towards the tab-insertion opening 14. This bottom opening 17*c* is at a height substantially corresponding to the deformation space 13 below the lock 12.

A long narrow jig J is insertable through at least the upper opening 17*a* of the jig insertion opening 17 from the front. The leading end of the inserted jig J is held in contact with the upper surface of the jig placing portion 12*b*. The jig J then is moved so that the contact portion is displaced down in a deflection direction of the lock 12. The lock 12 then is deformed down in the deflection direction against its resilient force. Thus, the locking projection 12*a* is disengaged from the female terminal fitting 20 to cancel the locking of the female terminal fitting 20 by the lock 12.

The jig insertion opening 17 and the positioning portion 15 of the tab insertion opening 14 are partitioned by a partition wall 18 to define substantially independent openings. This partition wall 18 includes the lower slanted surface of the guide 16. Thus, the tab 21*a* strikes against the partition wall 18 if the posture or orientation of the tab 21*a* to be inserted into the tab insertion opening 14 is displaced down towards the jig insertion opening 17. The jig J strikes the partition wall 18 if the posture or orientation of the jig J to be inserted into the jig insertion opening 17 is displaced up towards the tab insertion opening 14. The partition wall 18 may be damaged (e.g. fractured or deformed) if the tab 21*a* or the jig J strikes in this way. However, a countermeasure is taken in this embodiment. Specifically, reinforcements 19 bulge towards the center of the tab insertion opening 14 and have an inner arcuate surface substantially in the form of a conical section. The reinforcements 19 are at the four corners of the tab insertion opening 14 and correspond to the opposite ends of the upper, lower, left and right sides that form the tab insertion opening 14. Two reinforcements 19 at the opposite right and left ends of the partition wall 18 extend back towards the positioning portion 15 from positions displaced along the transverse direction TD (left and/or right) from the upper opening 17*a* of the jig insertion opening 17.

Each reinforcement 19 is formed substantially continuously from the opening edge of the guide 16 adjacent the front surface of the housing 10 to the rear edge of the positioning portion 15 adjacent the cavity 11. Front reinforcements 19*a* in the guide 16 are shaped so that a radius of curvature of the arcs thereof gradually increases from the front end of the housing 10 towards the cavity 11. The front opening of the guide 16 is substantially square, with four corners at substantially right angles. However, the rear opening of the guide 16 has four corners that take a rounded shape of a quarter circle. On the other hand, rear reinforcements 19*b* formed in the positioning portion 15 have inner circumferential surfaces substantially in the form of a section of a cylinder whose radius of curvature is constant from the front end to the rear end. The radius of curvature of the rear reinforcements 19*b* substantially equals the maximum radius of curvature at the rear ends of the front reinforcements 19*a*. Further, the respective reinforcements 19 and the respective flat inner surfaces at the upper, lower, left and right inner surfaces of the positioning portion 15 and the upper, lower, left and right inner surfaces of the guide 16 of the tab insertion opening 14 are smoothly continuous with each other.

The reinforcements 19 thicken the ends of each partition wall 18, and thus strengthen the partition walls 18. Accordingly, the partition wall 18 is less likely to be damaged or deformed if struck by the tab 21*a* or the like. The partition wall 18 is thicker only at the ends of the side edge of the tab insertion opening 14 extending along the partition wall 18. Thus, the tab insertion opening 14 still has a substantially rectangular shape and the insertion of the tab 21*a* is not hindered.

The upper edge of the upper opening 17*a* of the jig insertion opening 17 cuts into the bottom edge of the partition wall 18. Thus, a portion of the partition wall 18 excluding its opposite ends is thinned slightly. However, the opposite ends of the partition wall 18 are not recessed by the upper opening 17*a* and rather are thicker due to the front reinforcements 19*a*. Thus, the strength of the partition wall 18 is maintained or increased.

Boundaries between the side edges of the tab insertion opening 14 and the inner surfaces of the reinforcements 19 are corners, and stresses often concentrate at corners. However, the side edges of the tab insertion opening 14 and the inner surfaces of the reinforcements 19 are smoothly continuous with each other. Thus, stress concentrations are avoided The opening area of the guide 16 is at a maximum and the radius of curvature of the arcs of the reinforcements 19 at the corners of the guide 16 is at a minimum at the front surface of the housing 10. Thus, a larger opening area of the guide 16 is ensured and the reliability of guiding the displaced tab 21*a* to the cavity 11 is improved as compared to a case where the radius of curvature of the arcs of the reinforcements is substantially constant.

Figure 5:
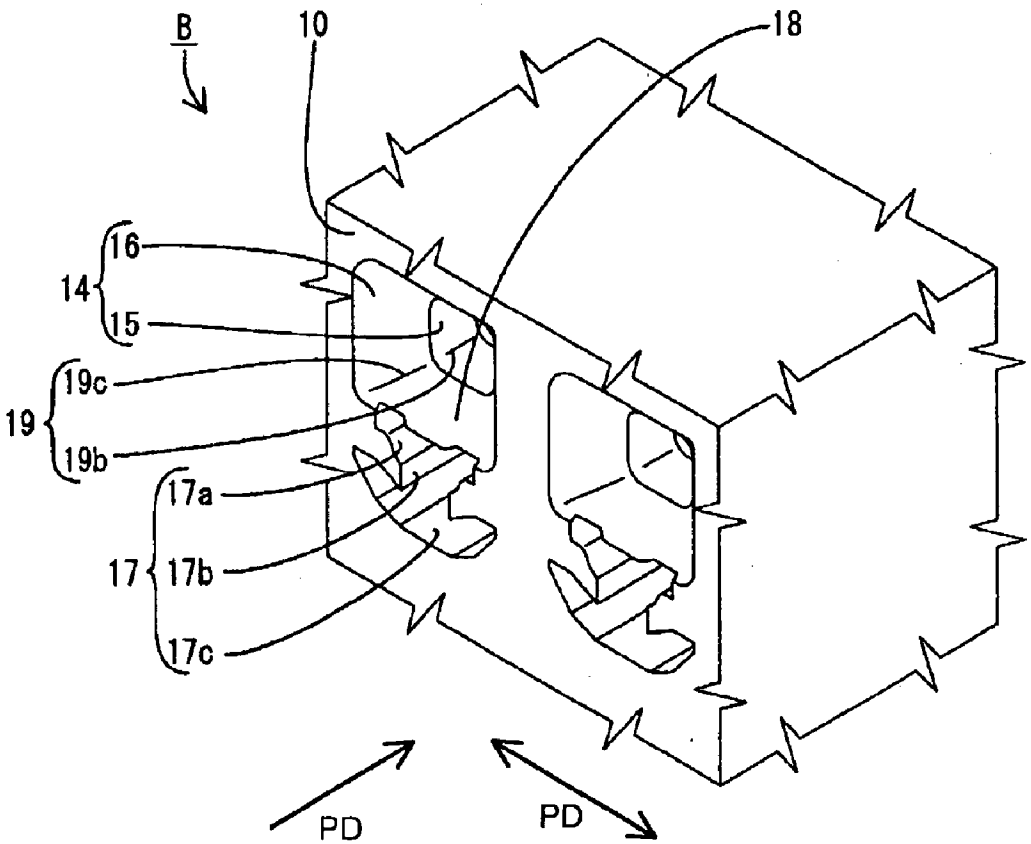
FIG. 5 is a partial perspective view of a connector according to a second embodiment.
Figure 6:
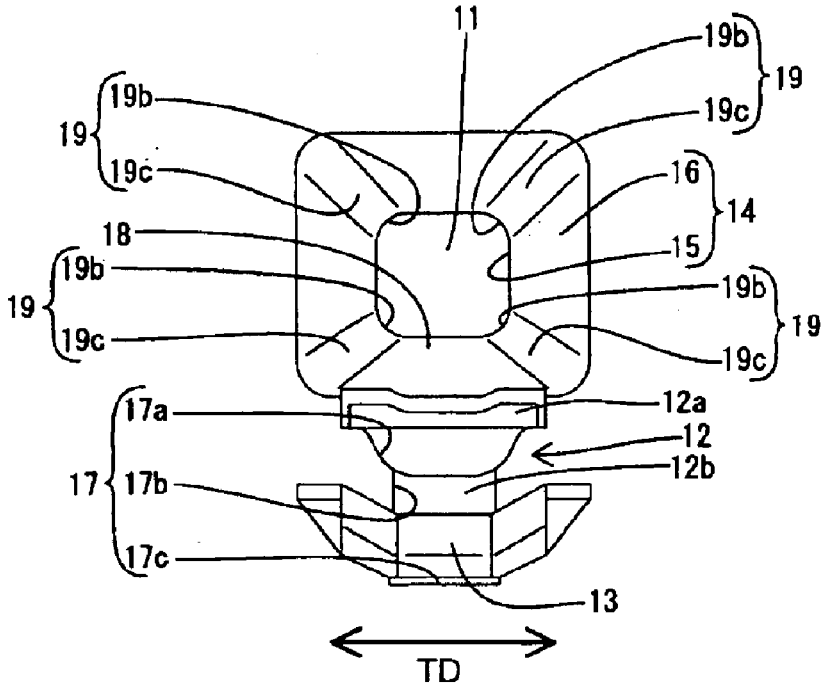
FIG. 6 is a partial enlarged front view of the connector according to the second embodiment.

The letter B in FIGS. 5 and 6 identifies a connector according to a second embodiment of the invention. The connector B has reinforcements 19 with a construction different from those of the first embodiment. In the first embodiment, each front reinforcement 19*a* of the guide 16 has a radius of curvature that gradually increases from the side of the front surface of the housing 10 toward the cavity side. Thus, the opening of the guide 16 at the front end is substantially square with four substantially right angle corners. However, the opening of the guide 16 at the rear end has four corners with a rounded substantially quarter circle shape. Contrary to this, the guide 16 of the second embodiment has front reinforcements 19*c* with a substantially constant radius of curvature over substantially the entire area from the front end to the rear end of the guide 16. Thus, the opening of the guide 16 at the front end is substantially a square, but with four rounded corners of a substantially quarter circle shape similar to the opening of the guide 16 at the rear end. Other elements, including the rear reinforcements 19*b* in the positioning portion 15, are similar to the first embodiment, and no description is given for these similar elements. Rather, similar parts merely are identified by the same reference numerals.

Figure 7:
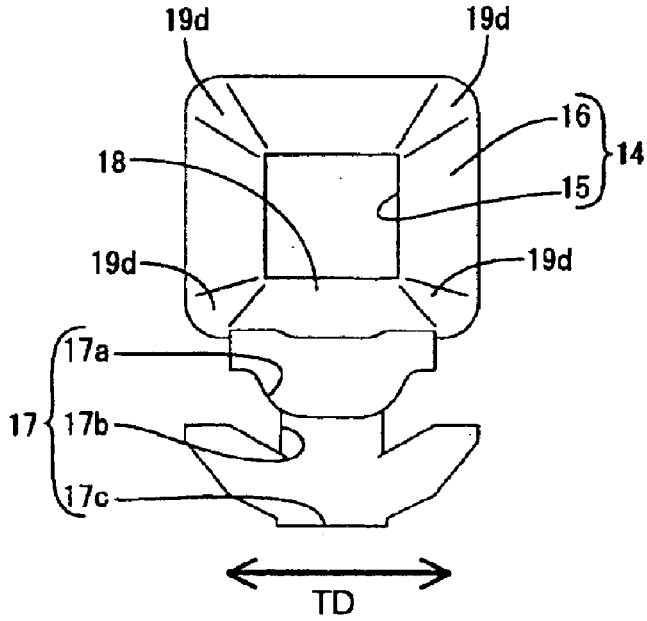
FIG. 7 is a partial enlarged front view showing the shapes of openings formed in the front end surface of a housing according to a third embodiment.

A connector according to a third embodiment of the invention is illustrated in FIG. 7, and has reinforcements 19 with a construction different from those of the first and second embodiments. In particular, a radius of curvature of arcs of front reinforcements 19*d* of the third embodiment gradually decreases from the side of the front surface of the housing 10 toward the cavity side. Thus, the opening of the guide 16 at the front is substantially a square, but has rounded corners substantially in the shape of a quarter circle. However, the opening of the guide 16 at the rear end is substantially a square with substantially right angle corners. The opening of the positioning portion 15 takes the substantially same shape as that of the guide 16 at the rear end. Thus, the positioning portion 15 has substantially no reinforcing portion.

The radius of curvature of the arcs at the four corners is at a minimum at the positioning portion 15, which is the portion of the tab insertion opening 14 through which the tab 21*a* closely penetrates. Thus, the inner surfaces of the positioning portion 15 can be close to the tab 21*a* to reduce vertical and/or transverse shaking of the tab 21*a*. Other elements are similar to the first embodiment, and no repeat description is given. Rather, those similar parts merely are identified by the same reference numerals.

Figure 8:
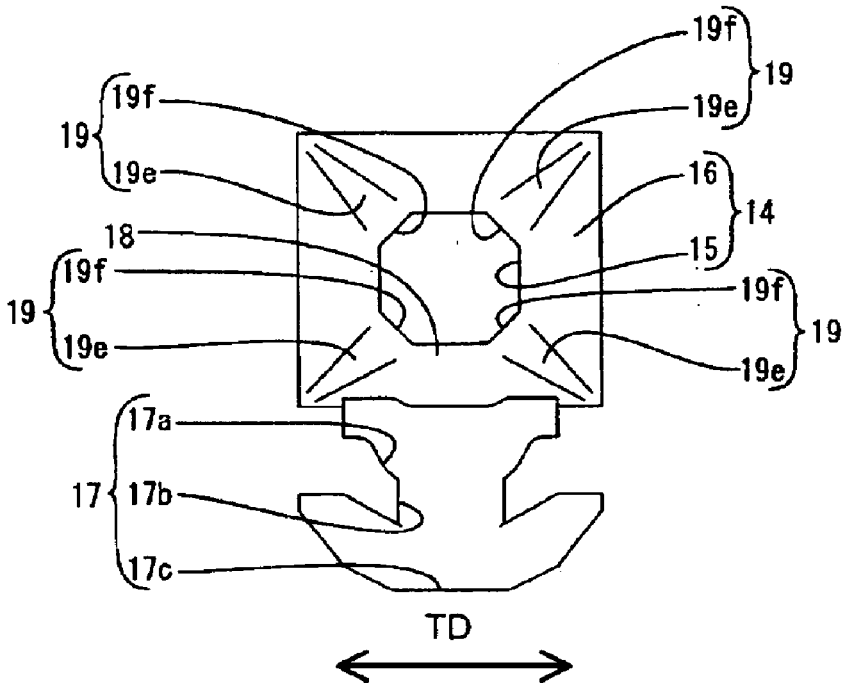
FIG. 8 is a partial enlarged front view showing the shapes of openings formed in the front end surface of a housing according to a fourth embodiment.

A connector according to a fourth embodiment of the invention is illustrated in FIG. 8 and has reinforcements 19 with a construction different from those of the first through third embodiments. In particular, the front reinforcements 19*e* of the fourth embodiment are slanted with respect to the transverse direction TD and have widths that gradually increase from the side of the front surface of the housing 10 towards the cavity side. Thus, the opening of the guide 16 at the front is substantially a square with substantially right angle corners. However, the opening of the guide 16 at the rear end is substantially an octagon or a square with four truncated corners slanted at about 45° with respect to the transverse direction TD. The opening of the positioning portion 15 and rear reinforcements 19*f* have substantially the same shapes as the guide 16 at the rear end. Other elements are similar to the first embodiment, and no repeat description is given. Rather, those similar parts merely are identified by the same reference numerals.

Figure 9:
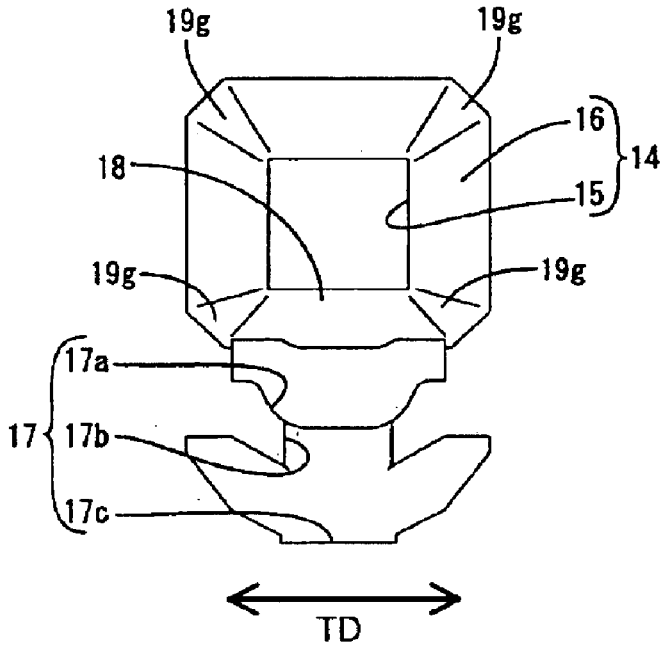
FIG. 9 is a partial enlarged front view showing the shapes of openings formed in the front end surface of a housing according to a fifth embodiment.
Figure 10:
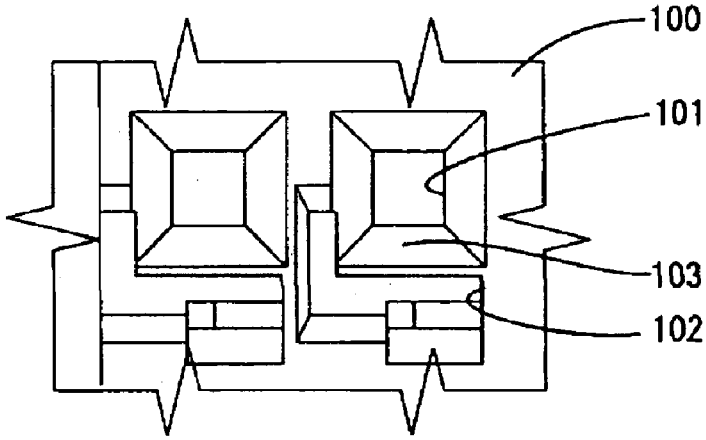
FIG. 10 PRIOR ART
FIG. 10 is a partial front view of a prior art connector.

A connector according to a fifth embodiment of the invention is illustrated in FIG. 9 and has reinforcements 19 with a construction different from those of the first through fourth embodiments. In particular, reinforcements 19*g* of the fifth embodiment are slanted and have widths that gradually decrease from the side of the front surface of the housing 10 toward the cavity side. Thus, the opening of the guide 16 at the front end is substantially an octagon or a square with four truncated corners slanted at about 45° with respect to the transverse direction TD. However, the opening of the guide 16 at the rear end is substantially a square with four substantially right angle corners. The opening of the positioning portion 15 has substantially the same shape as the guide 16 at the rear end. Thus, the positioning portion 15 has substantially no reinforcing portion. Other elements are similar to the first embodiment, and no repeat description is given. Rather, those similar parts merely are identified by the same reference numerals.

The invention is not limited to the above described and illustrated embodiments. For example, the following embodiments are also embraced by the technical scope of the present invention as defined by the claims. Beside the following embodiments, various changes can be made without departing from the scope and spirit of the present invention as defined by the claims.

The tab insertion openings have substantially square cross sections in the foregoing embodiments. However, the invention is also applicable to tab insertion openings that have a substantially rectangular cross section.

The housing is made of a single part in the foregoing embodiments. However, the invention also is applicable to a case where a housing is made of two or more parts, e.g. a housing main body for accommodating female terminal fittings and a holder mounted on a front end of the housing main body, and tab insertion openings and partition walls formed in the holder.

The openings partitioned from the tab insertion openings by the partition walls are jig insertion openings in the foregoing embodiments. However, the invention also is applicable to cases where openings partitioned from tab insertion openings by partition walls are for other purposes (e.g. openings used to insert a probe for checking an electrical connection, openings used for inserting portions of a retainer for doubly locking the terminal fittings into the connector housing or the like).

The tab insertion openings and the other openings are separated completely by the partition walls in the foregoing embodiments. However, the invention also is applicable to partition walls that are partly cut off and the tab insertion openings and the other openings communicate with each other through these cut portions of the partition walls.

Each tab insertion opening is formed with the guide in the foregoing embodiment. However, the invention also is applicable to a case where the tab insertion opening is formed with only a partial guide or with no guide.

The reinforcements are formed at all the four corners of each tab insertion opening in the foregoing embodiments. However, they may be formed only at the ends of the side edge of the tab insertion opening extending substantially along the partition wall.

The reinforcements are formed in the entire area from the front end of the tab insertion opening to the rear end thereof facing the cavity in the foregoing embodiment. However, they may be formed only at the opening edge against which a tab or a jig is likely to strike.

Although the reinforcing portions are substantially arcuate or slanted in the foregoing embodiments, arcuate and/or slanted reinforcing portions may be mixed in one tab insertion opening.

What is claimed is:

1. A connector, comprising:

a housing with at least one cavity for receiving at least one female terminal fitting, a tab insertion opening formed in a front surface of the housing and communicating with the cavity, the tab insertion opening having a substantially rectangular cross section and configured to permit insertion of a tab at the leading end of a male terminal fitting into the cavity, and an opening formed in the front end surface of the housing and at least partly partitioned from the tab insertion opening by a partition wall, wherein at least one reinforcement bulges out towards the center of the tab insertion opening from at least one end of the partition wall defining at least one corner of the tab insertion opening.

2. The connector of claim 1, wherein side edges of the tab insertion opening and an inner surface of the reinforcement are smoothly continuous with each other.

3. The connector of claim 1, wherein a tapered guide is formed at an opening edge of the tab insertion opening in the front surface of the housing and has an area that increases towards the front surface of the housing, and the reinforcement has an inner surface substantially in the form of a section of a cone, a radius of curvature of an arc of the inner surface of the reinforcement increases from the front surface of the housing towards a cavity side in the tapered guide.

4. The connector of claim 1, wherein a tapered guide is formed at an opening edge of the tab insertion opening in the front surface of the housing and has an area that increases from a cavity side towards the front surface of the housing, and the reinforcement has an inner surface substantially in the form of a section of a cone, a radius of curvature of an arc of the inner surface of the reinforcement decreases from the front surface of the housing towards the cavity side in the guide.

5. The connector of claim 1, wherein a tapered guide is formed at an opening edge of the tab insertion opening in the front surface of the housing and has an area that increases from a cavity side towards the front surface of the housing, and the reinforcement has a substantially slanted inner surface with a width that increases from the front surface of the housing toward the cavity side.

6. The connector of claim 1, wherein a tapered guide is formed at an opening edge of the tab insertion opening in the front surface of the housing and has an area that increases from a cavity side towards the front surface of the housing, and the reinforcement has a substantially slanted inner surface with a width that decreases from the front surface of the housing toward the cavity side.

7. The connector of claim 1, wherein the tab insertion opening comprises a positioning portion with a cross section for positioning the tab with respect to transverse and vertical directions.

8. The connector of claim 7, wherein the opening has a portion with a maximum width larger than a maximum width of the positioning portion, but smaller than a maximum width of the guide.

* * * * *